US009238974B2

(12) United States Patent
Cot et al.

(10) Patent No.: US 9,238,974 B2
(45) Date of Patent: Jan. 19, 2016

(54) TURBINE ENGINE SHAFT

(71) Applicant: MICROTURBO, Toulouse (FR)

(72) Inventors: Serge Cot, Seilh (FR); Clement Lalanne, Toulouse (FR)

(73) Assignee: MICROTURBO, Toulouse (FR)

( * ) Notice: Subject to any disclaimer, the term of this patent is extended or adjusted under 35 U.S.C. 154(b) by 594 days.

(21) Appl. No.: 13/732,661

(22) Filed: Jan. 2, 2013

(65) Prior Publication Data

US 2013/0177390 A1 Jul. 11, 2013

(30) Foreign Application Priority Data

Jan. 5, 2012 (FR) ..... 12 50099

(51) Int. Cl.
*F01D 25/18* (2006.01)

(52) U.S. Cl.
CPC ..... *F01D 25/18* (2013.01); *F05D 2240/61* (2013.01)

(58) Field of Classification Search
CPC .. F01D 25/18; F05D 2240/06; F05D 2260/98
USPC ..... 415/112; 384/392
See application file for complete search history.

(56) References Cited

U.S. PATENT DOCUMENTS

| | | | | |
|---|---|---|---|---|
| 2,999,000 | A | 9/1961 | Melvin | |
| 4,453,784 | A | 6/1984 | Kildea et al. | |
| 7,065,954 | B2 * | 6/2006 | Labala | F01D 25/18 184/11.2 |
| 2011/0158803 | A1 | 6/2011 | Sebald et al. | |

OTHER PUBLICATIONS

French Preliminary Search Report issued Oct. 12, 2012, in French 1250099, filed Jan. 5, 2012 (with English Translation of Categories of Cited Documents).

* cited by examiner

*Primary Examiner* — Edward Look
*Assistant Examiner* — Cameron Corday
(74) *Attorney, Agent, or Firm* — Oblon, McClelland, Maier & Neustadt, L.L.P.

(57) ABSTRACT

A shaft for a turbine engine, the shaft having a cavity subdivided axially into first and second chambers. The shaft also includes a distributor member having an axial duct, a first radial orifice, and a second radial orifice. The axial duct has an open first end and a second end closed in the axial direction. The first radial orifice connects the second end of the axial duct to the first chamber in order to feed a first bearing with lubricating fluid, and the second radial orifice connects the second end of the axial duct to the second chamber to feed a second bearing with lubricating fluid. The first radial orifice and the second radial orifice of the distributor member are at substantially equal axial distances from the lubricating fluid inlet.

7 Claims, 3 Drawing Sheets

TURBINE ENGINE SHAFT

BACKGROUND OF THE INVENTION

The present invention relates to the field of turbine engines, and more particularly to their lubrication.

In the present context, the term "turbine engine" covers any machine operating on the principle of transferring energy between at least one rotor and a flowing fluid. Among turbine engines, the present invention relates more particularly to engines having a gas turbine, and in particular to turboshaft engines, to turbojets, and to turboprops for aviation applications, for the purposes both of propulsion and of generating electricity.

In operation, turbine engines of such a type typically rotate at very high speeds, of the order of several tens of thousands of revolutions per minute. It is thus most important to ensure that they are lubricated in order to limit friction, in particular in bearings for supporting rotary parts. For that purpose, it is common practice to feed the bearings via lubricating ducts within the rotary parts they support.

When such a turbine engine has a plurality of bearings, it is normally appropriate to maintain a flow of lubricating fluid at a constant rate to each of the various bearings, independently of the speed of the engine, so that all of the bearings receive a sufficient flow of lubricating fluid. Nevertheless, when the bearings are fed with lubricating fluid via ducts in rotary parts, centrifugal forces can affect the distribution of lubricating fluid. There is thus a risk, at certain speeds, of a bearing being fed with too little lubricating fluid, while another bearing is fed with too much.

OBJECT AND SUMMARY OF THE INVENTION

The invention seeks to provide a turbine engine shaft having a cavity for feeding lubricating fluid to at least a first bearing supporting the shaft and to at least a second bearing supporting the shaft that is axially offset relative to the first bearing, and that enables lubricating fluid to be distributed to each of the bearings at a constant flow rate independently of the speed of rotation of the shaft.

In at least one embodiment, this object is achieved by the fact that said cavity is subdivided axially into first and second chambers, and the shaft also includes a distributor member having at least one axial duct with a first end that is open to a lubricating fluid inlet and a second end that is closed in the axial direction, at least one first radial orifice connecting the second end of the axial duct to the first chamber in order to feed the first bearing with lubricating fluid, and at least one second radial orifice connecting the second end of the axial duct of the distributor member to said second chamber in order to feed the second bearing with lubricating fluid. The at least one first radial orifice and the at least one second radial orifice of the distributor member are at substantially equal axial distances from the lubricating fluid inlet. The term "substantially equal" is used in the present context to mean that these distances do not present a difference greater than 10% of the smaller of the two distances, and preferably do not present a difference greater than 5%.

By means of these provisions, it is possible to obtain a substantially constant distribution of lubricating fluid flow rate between said first and second chambers, and thus between the two bearings that are mutually axially offset, with this being independent of the speed of rotation of the hollow shaft.

In particular, a plurality of radial orifices may connect the second end of the axial duct of the distributor member to each of the first and/or second chambers, thereby radially distributing the flow of lubricating fluid that flows through each portion of the axial cavity of the shaft.

In particular, an outer perimeter of said distributor member, in contact with an inner perimeter of said cavity, may form a seal separating said first and second chambers. In this way, the distributor member is easier to fabricate separately from a main hollow body of the shaft, and subsequently to house in the cavity of the shaft in order to subdivide it into two chambers.

In particular for the purpose of feeding each bearing with lubricating fluid, the first chamber and/or the second chamber may be in fluid flow communication with at least one outside surface of the shaft through at least one radial orifice.

The invention also provides a turbine engine comprising at least one rotor, at least one shaft such as the above-mentioned hollow shaft that is secured in rotation with said at least one rotor, and at least one first and at least one second bearing supporting said shaft. The turbine engine may in particular also include an electricity generator coupled to said shaft in order to be actuated by rotation of the shaft. The turbine engine may thus be used, for example, to supply electricity to an aircraft.

The invention also provides a method of feeding at least first and second support bearings of a turbine engine shaft, the second bearing being axially offset relative to the first bearing. In at least one implementation, a flow of lubricating fluid is introduced into an axial duct of the distributor member via a first end of said axial duct. The lubricating fluid flows along the axial duct towards a second end that is closed axially. A first fraction of the flow passes through at least one radial orifice in the distributor member from said second end of the axial duct to a first chamber of a cavity of said shaft. Simultaneously, a second fraction of the flow passes through at least one other radial orifice in the distributor member from said second end of the axial duct to a second chamber of said cavity that is axially separate from the first chamber. The first fraction of the flow passes via the first chamber to the first bearing and the second fraction of the flow passes via the second chamber to the second bearing.

BRIEF DESCRIPTION OF THE DRAWINGS

The invention can be well understood and its advantages appear more clearly on reading the following detailed description of an embodiment given by way of non-limiting example. The description refers to the accompanying drawings, in which.

DETAILED DESCRIPTION OF THE INVENTION

Figure 1:
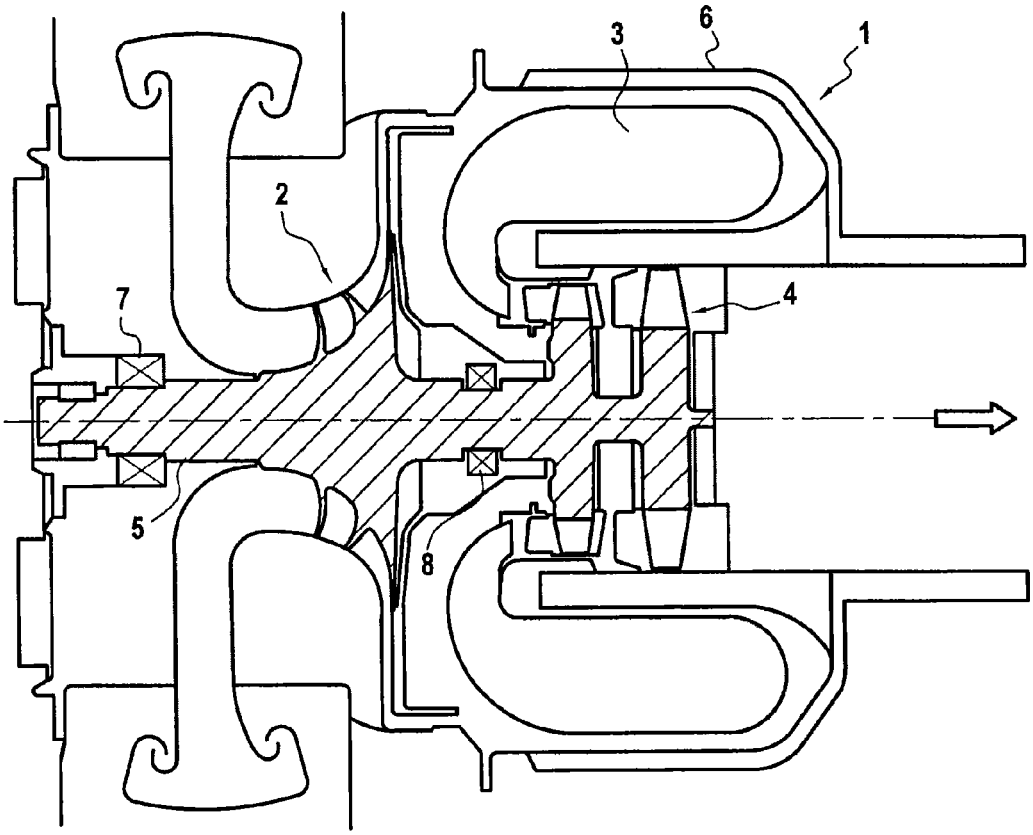
FIG. 1 is a diagrammatic longitudinal section view of a turbine engine.

FIG. 1 shows a turbine engine 1 in the form of a turboshaft engine having a compressor 2, a combustion chamber 3, and a turbine 4, and in which the compressor 2 and the turbine 3 are connected together by a common shaft 5 that is supported in a casing 6 by a first bearing 7 and a second bearing 8. By way of example, such an engine may be used for actuating an electricity generator that is used for powering the electrical equipment of an aircraft, and may typically reach operating speeds of several tens of thousands of revolutions per minute. It is therefore important to ensure that each of the two bearings 7 and 8 is appropriately lubricated at all operating speeds of the engine 1. For this purpose, each of the bearings 7, 8 is provided with lubricating fluid at an accurate flow rate. A flow rate that is too small for a given speed can lead to the bearing overheating, whereas a flow rate that is too high is equally disadvantageous, in particular in that it increases the engine's overall requirements for lubricating fluid while in operation, and thus increases its weight. In particular in the aerospace field, it is important to limit the overall mass of each component as much as possible.

Figure 2:
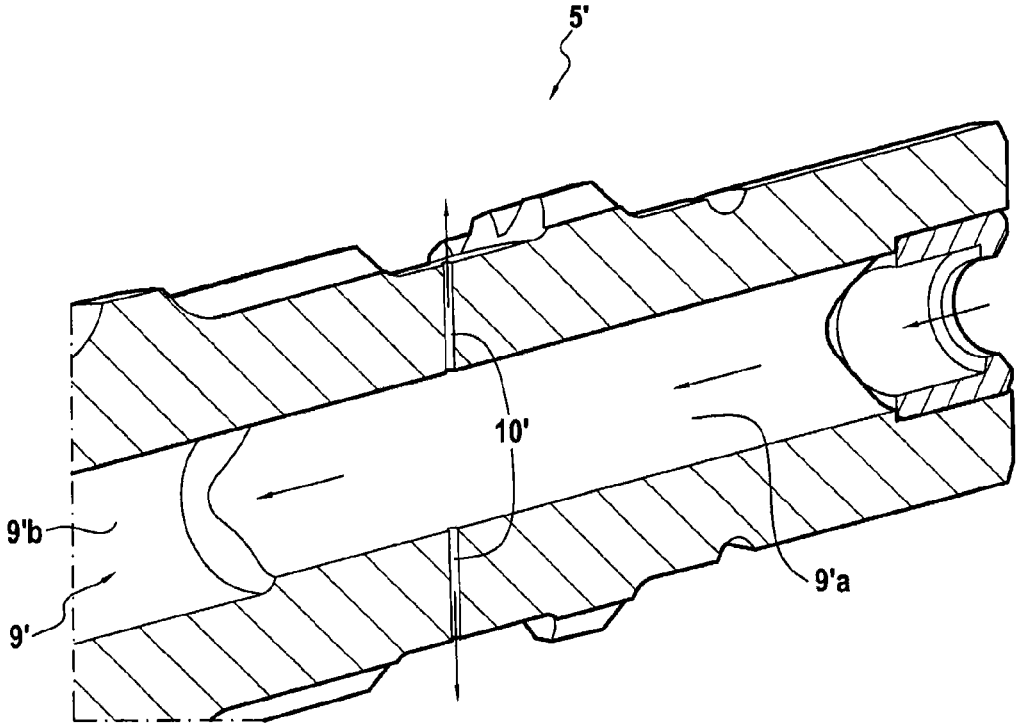
FIG.2 PRIOR ART
FIG. 2 is a cutaway view in perspective of a prior art engine shaft.

Typically, these lubricating fluid flow rates are delivered to the bearings via the shaft that they support. FIG. 2 shows a prior art shaft 5' for a turbine engine. The shaft 5' is hollow and has an internal cavity 9' that is open at a first end to receive a flow of lubricating fluid in the form of a jet coming from a nozzle. The internal cavity 9' presents a first portion 9'*a* of square section that is connected by radial holes 10' to an outside surface of the shaft 5' in order to feed a first bearing with lubricating fluid, and a second portion 9'*b* of round section in fluid flow communication with a second bearing 5' for supporting the shaft in order to feed it with lubricating fluid, which second bearing is axially offset relative to the first bearing. This hollow shaft 5' with two sections nevertheless suffers from the drawback of not ensuring a constant distribution of the lubricating fluid flow rate between the first and second bearings at all speeds. In particular, at low speeds, because of the high axial speed of the jet of fluid into the internal cavity 9', centrifugal force may be insufficient for deflecting a flow of lubricating fluid at a sufficient rate through the radial holes 10' leading to the first bearing.

Figure 3A:
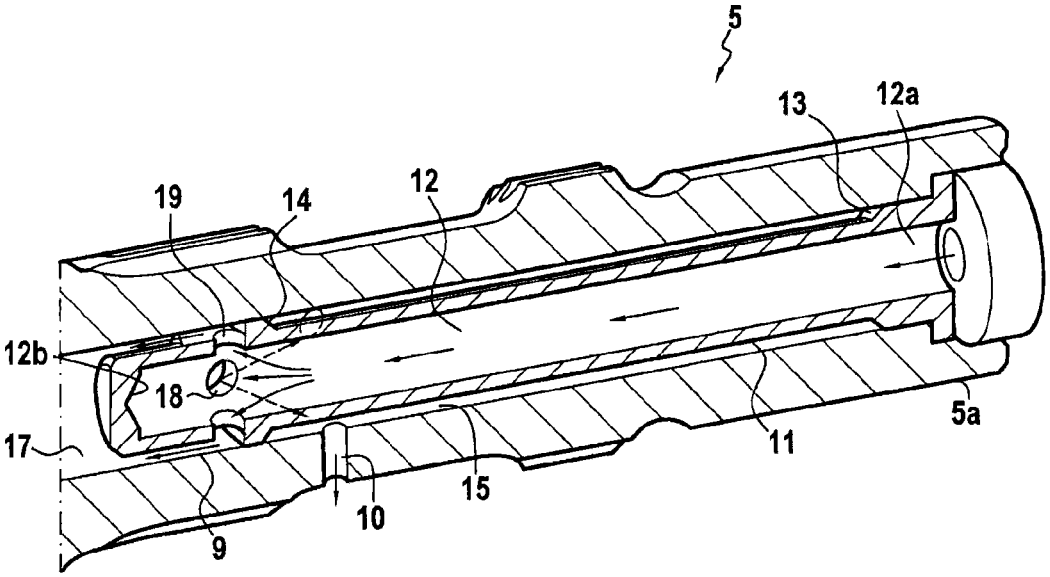
FIG. 3A is a first cutaway view in perspective of an engine shaft in one embodiment.
Figure 3B:
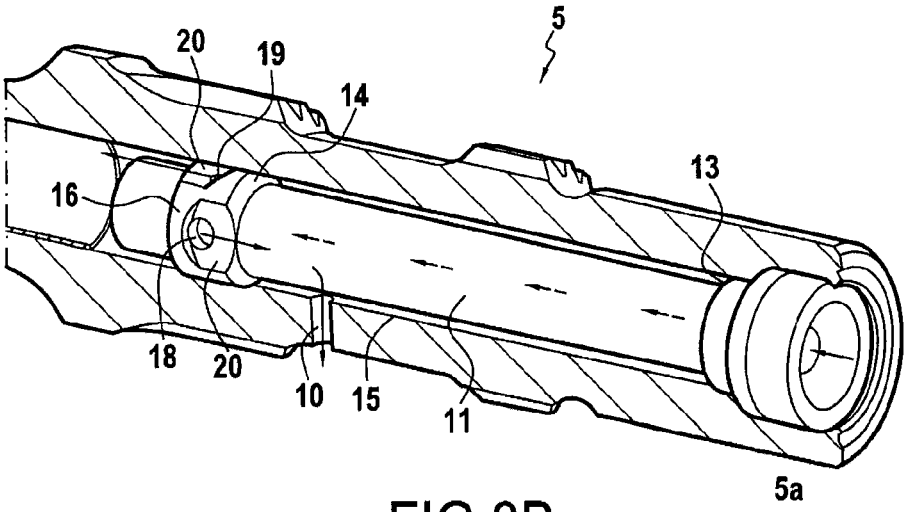
FIG. 3B is a second cutaway view in perspective of the FIG. 3A shaft, with the distributor member shown in longitudinal section.

FIGS. 3A and 3B show the shaft 5 of the turbine engine 1 in an embodiment of the invention. This shaft 5 is likewise hollow, having a cavity 9. Nevertheless, a distributor member 11 is housed inside the cavity 9 and secured to the shaft 5 both axially and in rotation. The distributor member 11 has an axial duct 12 with a first end 12*a* that is open to the lubricating fluid inlet beside a first end 5*a* of the shaft 5, and a second end 12*b* in the axial direction that is closed. On the outside, the distributor member 11 presents opposite radial shoulders 13, 14 defining a first chamber 15 in the cavity 9. Beyond the distal shoulder 14, an outer perimeter 16 of the distributor member 11 is in contact with an inner perimeter of the cavity 9 so as to form a seal separating said first chamber 15 from a second chamber 17 of the cavity 9.

In the distributor member 11, first radial orifices 18 connect the second end 12*b* of the axial duct 12 with the first chamber 15, while second radial orifices 19 connect said second end 12*b* with the second chamber 17. In the embodiment shown, the first and second radial orifices 18, 19 are situated at the same axial distance from the lubricating fluid inlet, and the outer surface of the distributor member 11 presents cutouts 20 providing fluid communication from the first and second radial orifices 18, 19 respectively with the first and second chambers 15, 17 without interrupting the contact of the outer perimeter 16 with the inner perimeter of the cavity 9 around the distributor member 11. In the embodiment shown, the distributor member 11 presents two of said first radial orifices 18 and two of said radial orifices 19, which orifices alternate with one another around the distributor member 11. Nevertheless, in other embodiments, other numbers and arrangements of radial orifices could be envisaged.

The first chamber 15 is in fluid flow communication with an outer surface of the shaft 5 forming the inner seat of the first bearing 7 via radial holes 10 in the shaft, while the second chamber 17 is in fluid flow communication with another outer surface of the shaft 5 forming the inner seat of the second bearing 8 through other ducts (not shown).

In operation, the flow of lubricating fluid enters in the form of a jet into the axial duct 12 via its first end 12*a*, and flows axially towards the second end 12*b*, which end, being axially closed, forms a plenum chamber. The lubricating fluid has its axial flow stopped in this way and therefore passes through the radial orifices 18 and 19 towards the chambers 15 and 17. In particular, a first fraction of the flow of lubricating fluid flows through the first radial orifices 18 towards the first chamber 15, while a second fraction of the flow of lubricating fluid flows through the second radial orifices 19 towards the second chamber 17. Since axial flow is braked in the proximity of the radial orifices 18, 19, the distribution of the flow rate of lubricating fluid between the first and second chambers 15 and 17 is not substantially affected by fluctuations in the speed of the engine or in the speed of the jet of lubricating fluid at the first end 12*a* of the axial duct 12.

From the first chamber 15, the first fraction of the flow of lubricating fluid can flow through the radial holes 10 towards the outside of the shaft 5 in order to lubricate the first bearing 7. Furthermore, the second fraction of the flow of lubricating fluid can flow through the ducts (not shown) towards the outside of the shaft 5 in order to lubricate the second bearing 8.

Although the present invention is described above with reference to a specific embodiment, it is clear that various modifications and changes may be performed to this embodiment without going beyond the general ambit of the invention as defined by the claims. In addition, the individual characteristics of the various embodiments mentioned may be combined in further embodiments. Consequently, the description and the drawings should be considered as being illustrative rather than restrictive.

The invention claimed is:

1. A turbine engine shaft comprising at least:

a cavity axially subdivided into first and second chambers for feeding lubricating fluid at least to a first bearing and to a second bearing that is axially offset relative to the first bearing; and a distributor member comprising at least:

an axial duct with an open first end at a lubricating fluid inlet and a second end that is closed in the axial direction;

at least one first radial orifice connecting the second end of the axial duct to the first chamber in order to feed the first bearing with lubricating fluid; and at least one second radial orifice connecting the second end of the axial duct to the second chamber in order to feed the second bearing with lubricating fluid, the at least one first radial orifice and the at least one second radial orifice of the distributor member being at substantially equal axial distances from the lubricating fluid inlet; and an outer perimeter of said distributor member, in contact with an inner perimeter of said cavity, forms a seal separating said first and second chambers.

2. A turbine engine shaft according to claim 1, wherein the second end of the axial duct is connected to the first chamber by a plurality of radial orifices.

3. A turbine engine shaft according to claim 1, wherein the second end of the axial duct is connected to the second chamber by a plurality of radial orifices.

4. A turbine engine shaft according to claim 1, wherein the first chamber and/or the second chamber are in fluid flow communication with at least one outside surface of the shaft through at least one radial hole.

5. A turbine engine having at least one rotor, at least one shaft according to any one of claims 1 to 4, which shaft is secured to rotate with at least one rotor, and at least first and second bearings supporting said shaft.

6. A turbine engine according to claim 5, further including an electricity generator coupled to said shaft in order to be actuated by rotation of the shaft.

7. A method of feeding at least first and second support bearings of a turbine engine shaft, the second bearing being axially offset relative to the first bearing, the method comprising the steps of:

introducing a flow of lubricating fluid into an axial duct of a distributor member through a first end of said axial duct;

allowing the lubricating fluid to flow along the axial duct towards an axially closed second end providing a first chamber of a cavity of said shaft fluidly separated from a second chamber of said cavity;

allowing a first fraction of the flow to pass through at least one first radial orifice in the distributor member from said second end of the axial duct to said first chamber of said cavity of said shaft;

simultaneously, allowing a second fraction of the flow to pass through at least one other radial orifice situated at substantially the same axial distance from the lubricating fluid inlet as the first radial orifice in the distributor member, from said second end of the axial duct to said second chamber of said cavity that is axially separate from the first chamber;

allowing said first fraction of the flow to pass via the first chamber to the first bearing; and allowing said second fraction of the flow to pass via the second chamber to the second bearing.

* * * * *